US005501585A

United States Patent [19]

Ogawa et al.

[11] Patent Number: 5,501,585

[45] Date of Patent: Mar. 26, 1996

[54] OIL PUMP HAVING A SEALING MECHANISM FOR A PUMPING CHAMBER

[75] Inventors: Tetsuyuki Ogawa, Handa; Hideki Nakayoshi, Kariya, both of Japan

[73] Assignee: Aisin Seiki Kabushiki Kaisha, Kariya, Japan

[21] Appl. No.: 348,239

[22] Filed: Nov. 28, 1994

[30] Foreign Application Priority Data

Nov. 26, 1993 [JP] Japan ..... 5-297107

[51] Int. Cl.[6] ..... F01C 1/10

[52] U.S. Cl. ..... 418/171; 418/71

[58] Field of Search ..... 418/71, 171, 166

[56] References Cited

U.S. PATENT DOCUMENTS

| | | | |
|---|---|---|---|
| 3,034,446 | 5/1962 | Brundage . | |
| 3,427,983 | 2/1969 | Brundage | 418/71 |
| 4,820,138 | 4/1989 | Bollinger . | |
| 4,976,595 | 12/1990 | Taniguchi | 418/171 |

FOREIGN PATENT DOCUMENTS

| | | | |
|---|---|---|---|
| 2843447 | 4/1980 | Germany . | |
| 60-192295 | 12/1985 | Japan . | |
| 61-48984 | 4/1986 | Japan . | |
| 61-179385 | 11/1986 | Japan . | |
| 2-75783 | 3/1990 | Japan . | |
| 0242482 | 10/1991 | Japan | 418/171 |

*Primary Examiner*—Charles Freay
*Attorney, Agent, or Firm*—Oblon, Spivak, McClelland, Maier & Neustadt

[57] ABSTRACT

In an oil pump having an inner rotor and an outer rotor supported in a housing, pressure in a pumping chamber whose volume is at maximum presses the inner rotor inwardly and the outer rotor outwardly. An oil groove which communicates with a discharge port via a lubricating groove is formed in an inner surface of the housing at the circumferential position of the pumping chamber whose volume is at maximum. The oil groove has axial sealing surfaces.

4 Claims, 2 Drawing Sheets

OIL PUMP HAVING A SEALING MECHANISM FOR A PUMPING CHAMBER

BACKGROUND OF THE INVENTION

1. Field of the Invention

The present invention relates to an oil pump having a sealing mechanism for a pumping chamber.

2. Background of the Related Art

A conventional oil pump, as shown in FIG. 5, is disclosed in Japanese Utility Model Laid-open No. 61(1986)-179385. An inner rotor 100 and an outer rotor 101 are rotatably supported in a housing 102 and have lobes which mesh with each other. A shaft 105 drives the rotor 100, and the rotor 101 via the rotor 101. Revolution centers of the rotors 100 and 101 are different from each other so that spaces 110 of varying volumes are formed therebetween. One of the spaces 110 which starts to communicate with suction port 103 has the smallest volume, and each of the succeeding spaces 110 in the direction of rotation of the rotors becomes larger in volume. When each of the spaces 110 is located at a position where the respective space 110 is in communication with neither the suction port 103 nor a discharge port 104, the volume of the respective spaces 110 becomes largest. The space having the largest volume is designated by numeral 111. After that, each of the spaces 110 becomes smaller in volume during further revolution of the rotors 100 and 101.

A pocket 120 is formed in the housing 102 and is located opposite to the space 111. The pocket 120 communicates with the discharge port 104 via a passage 121 which is also formed in the housing 102.

Oil pressure in the space 111 is high and pushes the inner rotor 100 inwardly and the outer rotor 101 outwardly. However, the pressure in the pocket 120, which communicates with the discharge port 104 via the passage 121, pushes the outer rotor 101 inwardly. Thus the gap between the rotors 100 and 101 which is generated by the pressure in the space 111 is controlled to a minimum and the leakage of oil through the gap into suction port 103 via the spaces 110 communicating with the suction port 103 is controlled.

The pocket 120 and the passage 121 accordingly act as a sealing mechanism for the space 111. However, forming such a passage 121 within the housing is complicated.

SUMMARY OF THE INVENTION

It is an object of the present invention to provide an oil pump which has a simple structure of a sealing mechanism for a pumping chamber.

It is a further object of the present invention to provide an oil pump which has a sealing mechanism for a pumping chamber but does not require formation of a passage in the housing.

According to one feature of the present invention, the above and other objects are carried out by an oil pump comprising a pump housing having a cylindrical portion, an inner rotor rotatably disposed in the cylindrical portion, an outer rotor rotatably disposed in the cylindrical portion, the outer rotor having lobes meshing with lobes of the inner rotor to form pumping chambers therebetween,a suction port formed in the pump housing, the suction port communicating with at least one of the pumping chambers, a discharge port provided in the pump housing, the discharge port communicating with at least one of the pumping chambers, wherein one of said pumping chambers is fluidically separated from both of said suction and discharge ports, a first groove formed in a radially inner surface of the cylindrical portion and communicating with the discharge port, a second groove formed in the radially inner surface of the cylindrical portion and communicating with the discharge port via the first groove, the second groove being positioned at the circumferential location of said one of said pumping chambers which is fluidically separated from both of said suction and discharge ports, and sealing surfaces formed at opposite axial sides of said second groove to prevent oil leakage from the second groove.

According to another feature of the present invention, the above and other objects are carried out by an oil pump comprising a pump housing having a cylindrical portion, an inner rotor rotatably disposed in the cylindrical portion, an outer rotor rotatably disposed in the cylindrical portion, the outer rotor having lobes meshing with lobes of the inner rotor to form pumping chambers therebetween, a suction port provided in the pump housing, the suction port communicating with at least one of the pumping chambers, a discharge port provided in the pump housing, the discharge port communicating with at least one of the pumping chambers, a first groove formed in a radially inner surface of the cylindrical portion and directly communicating with the discharge port, a second groove formed in the radially inner surface of the cylindrical portion and communicating continuously with the first groove, the second groove being positioned at the circumferential location of one of said pumping chambers whose volume is at a maximum, and sealing surfaces formed at opposite axial sides of said second groove to prevent oil leakage from the second groove.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
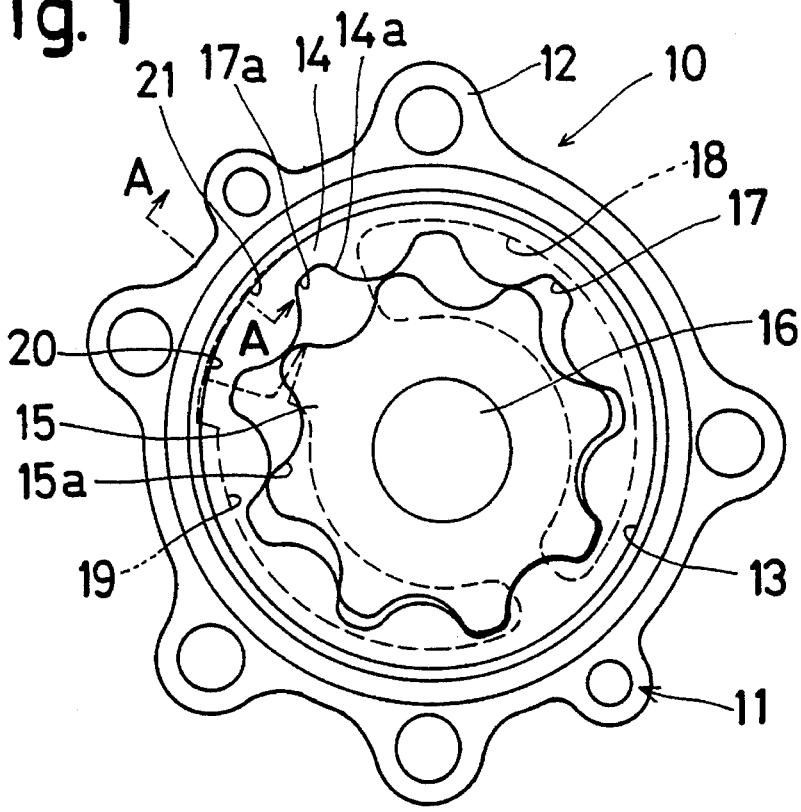
FIG. 1 is a front view of the internal part of an oil pump according to an embodiment of the invention.
Figure 5:
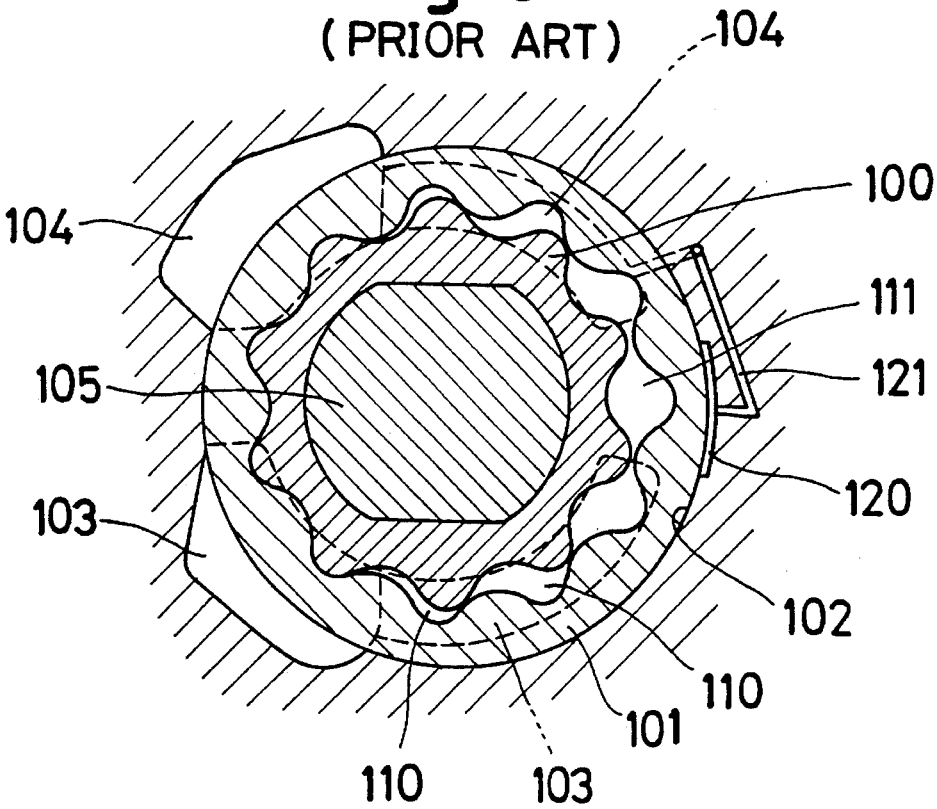
Fig. 5 (PRIOR ART)
FIG. 5 is a cross-sectional view of a conventional oil pump.
Figure 3:
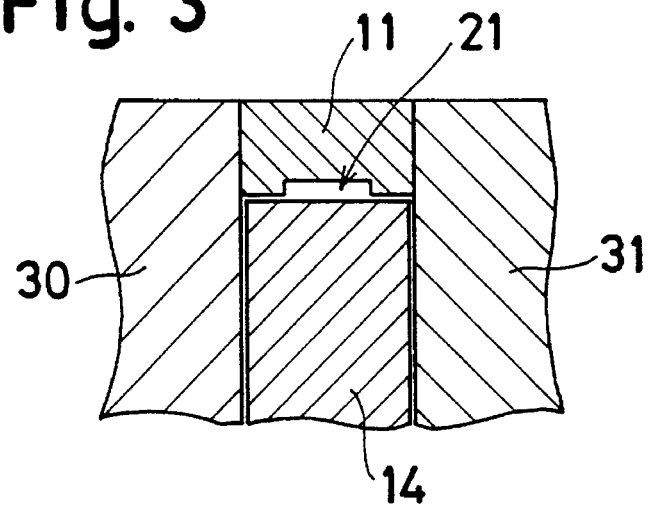
FIG. 3 is a sectional view cut along line III—III of FIG. 1 with a body and a cover.

Referring first to FIGS. 1 and 3, an oil pump 10 is shown. Housing 11 is fixed to a cylinder-block (not shown) of an engine (not shown) and forms a cylindrical portion 13 therein. The cylindrical portion 13 of the housing is closed by a cover 30 and a body 31 (both are shown in FIG. 3).

An outer rotor 14 is rotatably located in the cylindrical portion 13. An outer surface of the outer rotor 14 contacts with an inner surface of the cylindrical portion 13. The outer rotor 14 has inner lobes **14*a* which mesh with outer lobes 15*a* of an inner rotor 15**.

The inner rotor 15 is driven by a shaft 16 which is directly or indirectly connected with a crankshaft (not shown) of the engine. A revolution center of the outer rotor 14 is different from a revolution center of the inner rotor 15. A plurality of pumping chambers 17 are formed between the spaces between the lobes 14*a* of the outer rotor 14 and the lobes 15*a* of the inner rotor 15. The volume of each of the pumping chambers 17 is expanded and compressed repeatedly during the rotational movement of the rotors 14 and 15.

A suction port 18 and a discharge port 19 are formed on the body 31. At any given time, some of the chambers 17 communicate with the suction port 18 and some of the chambers 17 communicate with the discharge port 19. No chambers 17 simultaneously communicate with both the suction port 18 and the discharge port 19. Moreover, when the volume of a pumping chamber 17 becomes maximum (maximum volume chamber 17*a*), it communicates with neither the suction port 18 nor the discharge port 19.

Figure 2:
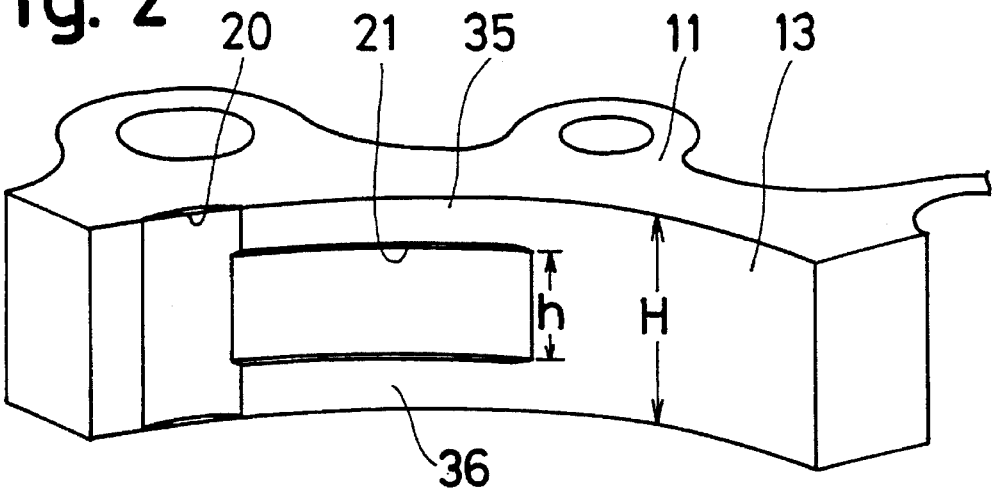
FIG. 2 is a partial perspective view of FIG. 1.

Referring to FIGS. 1 and 2, a lubricating groove 20 (a first groove) is formed on the inner surface of the cylindrical portion 13 (an inner surface of the housing 11) and communicates with the discharge port 19. The groove 20 extends to both axial ends of the cylindrical portion 13. A small amount of oil in the groove 20 leaks between the inner surface of the cylindrical portion 13 and the outer surface of the rotor 14 for lubrication therebetween.

An oil groove 21 (a second groove) is formed on the inner surface of the cylindrical portion 13 in communication with the lubricating groove 20 and without any restriction orifice. The oil groove 21 is located at the circumferential position of the maximum chamber 17*a*. The groove 21 extends in a circumferential direction of the cylindrical portion 13 and has a constant depth in the circumferential direction of the cylindrical portion 13. That is, the groove 21 is located not only at the circumferential position of the maximum chamber 17*a* but also at the circumferential position of the pumping chamber 17 which communicates with neither the suction port 18 nor the discharge port 19.

The height (h) of the groove 21 is smaller than that (H) of the cylindrical portion 13 so as to leave lateral sealing surfaces 35 and 36 in the cylindrical portion 13 at opposite axial sides of the groove 21. The groove 21 communicates with the discharge port 19 via the lubricating groove 20. The lubricating groove 20 does not restrict oil flow from the discharge port 19 to the oil groove 21. The lubricating groove 20 and oil groove 21 act as a sealing mechanism in cooperation with the sealing surfaces 35 and 36.

The inner rotor 15 and the outer rotor 14 meshing therewith are driven according to the revolution of the shaft 16. That is, the rotation of the shaft 16 drives the inner rotor 15, which in turn drives the outer rotor by virtue of their meshing lobes. During this time, the volume of each pumping chamber 17 is varied to carry out pumping action. As soon as one of the pumping chambers 17 starts to communicate with the suction port 18, the pressure in the chamber becomes low. On the other hand, as soon as one of the pumping chambers 17 starts to communicate with the discharge port 19, the pressure in the chamber becomes high. When the maximum volume chamber 17*a* starts to communicate with the discharge port 19, pressure in the maximum volume chamber 17*a* becomes high immediately. The pressure in the maximum chamber 17*a* then pushes the outer rotor 14 outwardly and the inner rotor 15 inwardly. At the same time, the pressure in the oil groove 21, which communicates with the discharge port 19 via the lubricating groove 20, pushes the outer rotor 14 inwardly to minimize the gap between the lobes of the inner and outer rotors.

Oil in the groove 21 does not leak to the axial ends of the cylindrical portion 13 because of the sealing function of the surfaces 35 and 36. Accordingly, the pressure in the oil groove 21 pushes the outer rotor 14 sufficiently inwardly that gaps between the rotors 14 and 15 generated by the pressure in the maximum chamber 17*a* is controlled to be minimum. That is, oil leaked through the gap into the pumping chambers communicating with the suction port 18 is limited and the oil pump 10 has a high pumping capacity.

Figure 4:
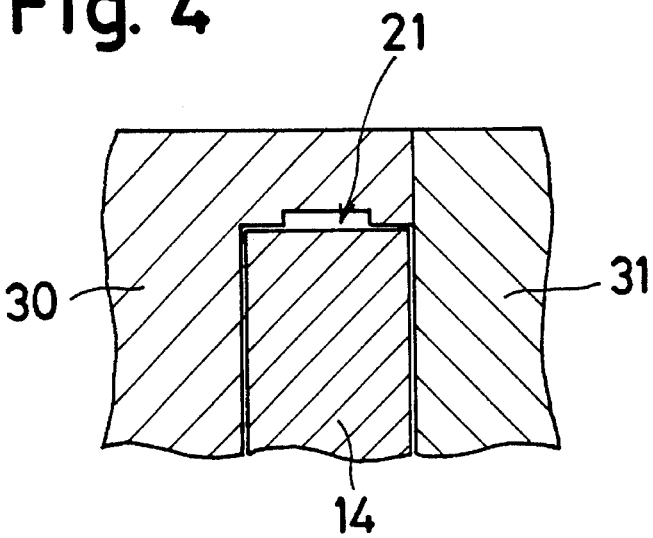
FIG. 4 is similar to FIG. 3, but shows another embodiment of the invention.

When the housing 11 is made of iron, the strength of the housing 11 is high. It is also possible that the housing 11 is formed integrally with the body 30 as shown in FIG. 4.

Obviously, numerous modifications and variations of the present invention are possible in light of the above teachings. It is therefore to be understood that the invention may be practiced otherwise than as specifically described herein.

What is claimed as new and desired to be secured by Letters Patent of the United States is:

1. An oil pump comprising:

a pump housing having a cylindrical portion;

an inner rotor rotatably disposed in the cylindrical portion;

an outer rotor rotatably disposed in the cylindrical portion, the outer rotor having lobes meshing with lobes of the inner rotor to form pumping chambers therebetween;

a suction port formed in the pump housing, the suction port communicating with at least one of the pumping chambers;

a discharge port provided in the pump housing, the discharge port communicating with at least one of the pumping chambers, wherein one of said pumping chambers is fluidically separated from both of said suction and discharge ports;

a first groove formed in a radially inner surface of the cylindrical portion and communicating with the discharge port;

a second groove formed in the radially inner surface of the cylindrical portion and directly communicating continuously with the first groove, the second groove being positioned at the circumferential location of said one of said pumping chambers which is fluidically separated from both of said suction and discharge ports; and sealing surfaces formed at opposite axial sides of said second groove to prevent oil leakage from the second groove;

wherein said discharge port is facing the side surface of the inner rotor and the outer rotor, an outer edge of the discharge port positioning inside of the outer edge of the outer rotor has a portion against the first groove, and the first groove is directly connecting with the portion of the discharge port.

2. The oil pump of claim 1 wherein there is no fluid flow restriction between the discharge port and the second groove.

3. An oil pump comprising:

a pump housing having a cylindrical portion;

an inner rotor rotatably disposed in the cylindrical portion;

an outer rotor rotatably disposed in the cylindrical portion, the outer rotor having lobes meshing with lobes of the inner rotor to form pumping chambers therebetween;

a suction port formed in the pump housing, the suction port communicating with at least one of the pumping chambers;

a discharge port provided in the pump housing, the discharge port communicating with at least one of the pumping chambers;

wherein one of said pumping chambers is fluidically separated from both of said suction and discharge ports;

a first groove formed in a radially inner surface of the cylindrical portion and directly communicating with the discharge port;

a second groove formed in the radially inner surface of the cylindrical portion and directly communicating continuously with the first groove, the second groove being positioned at the circumferential location of one of said pumping chambers whose volume is at a maximum; and sealing surfaces formed at opposite axial sides of said second groove to prevent oil leakage from the second groove;

wherein said discharge port is facing the side surface of the inner rotor and the outer rotor, an outer edge of the discharge port positioning inside of the outer edge of the outer rotor has a portion against the first groove, and the first groove is directly connecting with the portion of the discharge port.

4. The oil pump of claim 3 wherein there is no fluid flow restriction between the discharge port and the second groove.

* * * * *